United States Patent [19]

Schmidt et al.

[11] Patent Number: 4,460,899

[45] Date of Patent: Jul. 17, 1984

[54] SHIELD FOR IMPROVING THE DECOUPLING OF ANTENNAS

[75] Inventors: Peter Schmidt, Stuttgart; Siegfried Kulka, Waldenbuch, both of Fed. Rep. of Germany

[73] Assignee: Metalltechnik Schmidt GmbH & Co., Fed. Rep. of Germany

[21] Appl. No.: 341,857

[22] Filed: Jan. 22, 1982

[30] Foreign Application Priority Data

Jan. 24, 1981 [DE] Fed. Rep. of Germany ..... 3102323

[51] Int. Cl.[3] ..... H01Q 1/52

[52] U.S. Cl. ..... 343/841; 343/895

[58] Field of Search ..... 343/895, 841, 844, 846

[56] References Cited

U.S. PATENT DOCUMENTS

| | | | |
|---|---|---|---|
| 2,441,615 | 5/1948 | Brown | 343/840 |
| 2,455,403 | 12/1948 | Brown | 343/841 |
| 2,811,624 | 10/1957 | Haagensen | 343/841 |
| 3,681,770 | 8/1972 | Alford | 343/841 |
| 3,739,392 | 6/1973 | Ross et al. | 343/840 |
| 3,757,345 | 9/1973 | Carver | 343/895 |
| 3,932,876 | 1/1976 | Ben-Dov | 343/895 |
| 4,242,686 | 12/1980 | MacTurk | 343/912 |
| 4,400,703 | 8/1983 | Shiokawa et al. | 343/895 |

*Primary Examiner*—Eli Lieberman

*Attorney, Agent, or Firm*—Hopgood, Calimafde, Kalil, Blaustein & Judlowe

[57] ABSTRACT

The invention contemplates structure for improving the decoupling of helical transmitting and/or receiving antennas of at least one pair of antennas having oppositely directed circular polarization and which are perpendicular to an electrically conductive reflector wall. The device considerably increases the decoupling of such pairs of antennas by means of at least one electrically conductive partition wall which is disposed midway between the two antennas of a pair of antennas, particularly between a transmitting and a receiving antenna, the partition wall being also perpendicular to the reflector wall and electrically conductively connected thereto.

Various embodiments are disclosed, ranging from the simple case of a single pair of antennas wherein the partition wall is flat, to a more complex case involving an array of four pairs of antennas wherein plural curved partition walls are employed.

6 Claims, 5 Drawing Figures

SHIELD FOR IMPROVING THE DECOUPLING OF ANTENNAS

BACKGROUND OF THE INVENTION

This invention relates to means for decoupling adjacent helical antennas, which may be transmitting and/or receiving antennas, wherein the antennas of at least one pair are of oppositely directed circular polarization and are perpendicular to an electrically conductive flat reflector wall.

It is known that the decoupling of helical transmitting and receiving antennas of a pair of adjacent antennas which have the same direction of circular polarization is very much stronger than in the case of opposite circular polarization.

BRIEF STATEMENT OF THE INVENTION

The object of the present invention is considerably to improve the decoupling, for the case of circular polarization in opposite directions.

The invention achieves this object by providing structure which is characterized by at least one electrically conductive partition wall extending midway between the two antennas of a pair of antennas, and particularly between a transmitting and a receiving antenna, the partition wall being perpendicular to the reflector wall and electrically connected thereto. The partition wall screens the receiving antenna from the corresponding transmitting antenna, and the extent of decoupling depends primarily on the height of the partition wall, measured perpendicular to the reflector wall.

Preferred embodiments of the invention are characterized by the fact that the height of the partition wall corresponds essentially to a half wavelength. Such dimensioning achieves the greatest possible decoupling with the smallest possible decrease in the antenna gain, and thus optimal decoupling is obtained, substantially independent of the distance between the antennas and of the length of the partition wall measured parallel to the reflector wall.

The partition wall is preferably a metal sheet or a grid wherein mesh size is small compared with wavelength, configurated for easy manufacture and application.

When applying the invention to a single pair of antennas, the partition wall may be flat and its length measured parallel to the reflector wall preferably corresponds at least to one wavelength. In this way, the near field of the transmitting antenna is reliably separated from the near field of the receiving antenna.

When applying the invention to an array involving two pairs of antennas, the two transmitting antennas are preferably positioned on a first diagonal of the array, and the two receiving antennas are positioned on a second diagonal, and between each adjacent pair of antennas a flat partition wall is arranged, such that all partition walls meet at the center of the antenna array and are electrically conductively connected. In this way, a simple, easily produced, and effective arrangement is provided.

When applying the invention to an array involving four pairs of antennas, the four transmitting or receiving antennas occupy the four corners of an outer square, while the four receiving or transmitting antennas respectively occupy the four corners of an inner square, wherein diagonals of the inner square are at 45° angular offset with respect to those of the outer square; between each outer transmitting or receiving antenna and the adjacent two inner receiving or transmitting antennas a partition wall is provided, the same being arcuately curved about the particular outer transmitting or receiving antenna. In this simple manner, and as in the case of the array involving two pairs of antennas, all receiving antennas are screened from each transmitting antenna.

DETAILED DESCRIPTION OF THE INVENTION

The invention will be described in detail for several illustrative embodiments, in conjunction with the accompanying drawings, in which.

Figure 1:
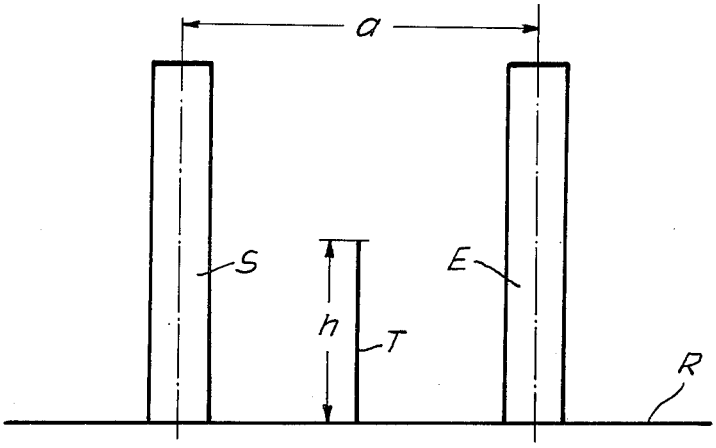
FIG. 1 is a diagrammatic side-elevation view of a first embodiment.
Figure 2:
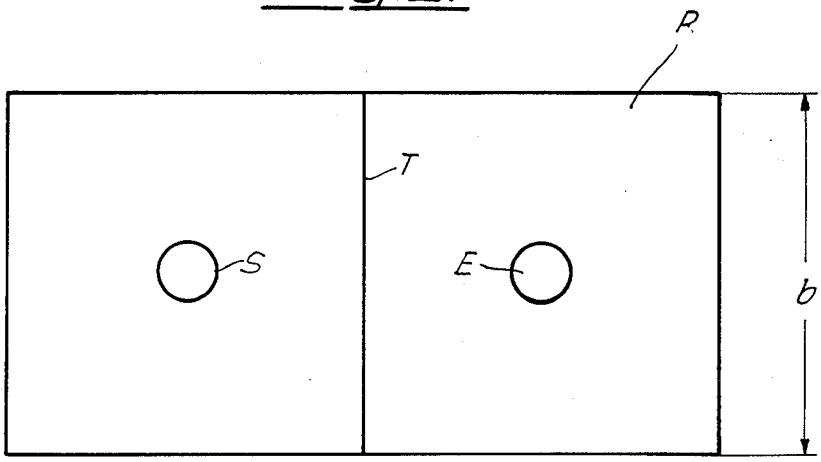
FIG. 2 is a top view of the embodiment of FIG. 1.

The first embodiment, shown in FIGS. 1 and 2, is intended and suitable for the decoupling of two helical transmitting and receiving antennas S and E, respectively, of a pair of spaced antennas characterized by opposite directions of circular polarization, the antenna spacing being designated a. Antennas S and E are disposed perpendicular to an electrically conductive flat rectangular reflector wall R of sheet metal. An electrically conductive flat rectangular partition wall T of sheet metal is positioned midway between the two antennas S and E, perpendicular to the reflector wall R, and electrically conductively connected thereto. The arrangement is such that the junction line of the partition wall T coincides with the shorter center line of the rectangle of the reflector wall R and that the geometrical plane which includes the longitudinal axes of the two antennas S and E extends along the longer center line of the rectangle of the reflector wall R. The height h of the partition wall T, measured perpendicular to the reflector wall, should correspond to the mean half of the operating wavelength $\lambda$ of electromagnetic waves radiated by the transmitting antenna S and received by the receiving antenna E. The width b of the reflector wall R measured perpendicular to the geometrical plane of the axes of antennas S and E should correspond to $\lambda$. The antenna spacing a should also equal $\lambda$.

Figure 3:
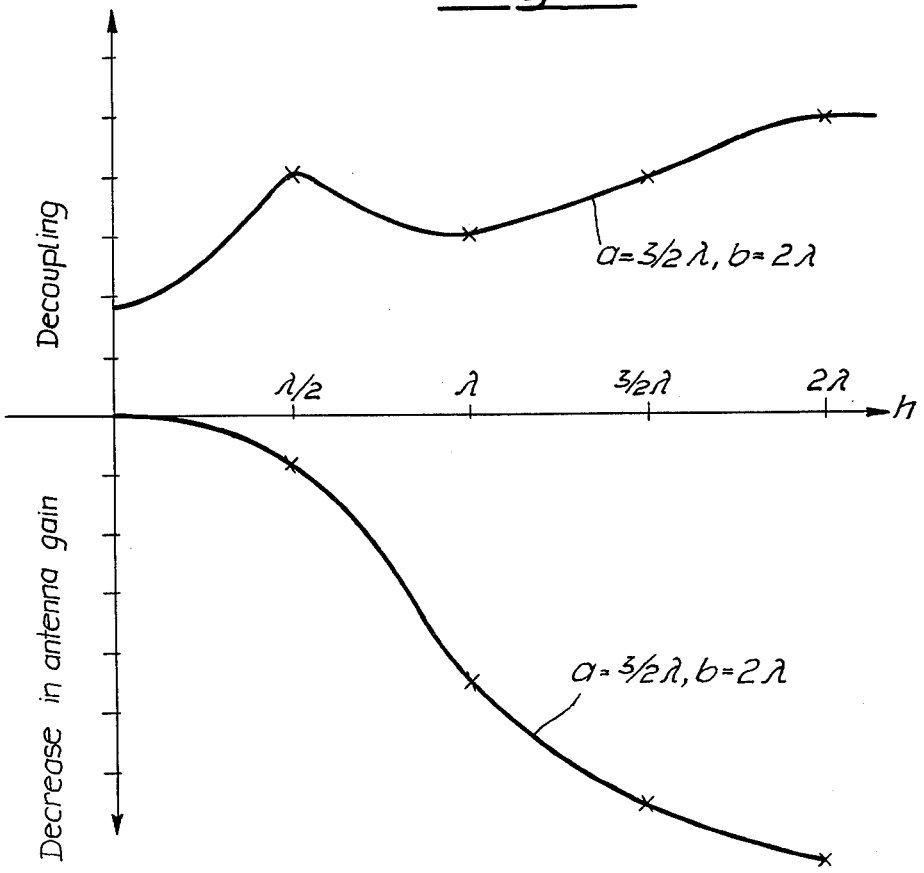
FIG. 3 is a diagram which graphically depicts, for the embodiment of FIG. 1, the respective extents of decoupling and of the decrease in antenna gain, as functions of height of the partition wall, height being expressed in terms of wavelength.

In FIG. 3, "decoupling" and "decrease in antenna gain" are shown as a function of the height of the partition wall h for the parameters $a=3\lambda/2$ and $b=2\lambda$. It is evident that optimum decoupling is present at the intermediate maximum occurring for a partition height of $\lambda/2$, which shows twice as much decoupling as when the partition wall is absent ($h=0$); under the same condition ($a=3\lambda/2$) antenna gain has decreased by only a small amount. More specifically, for example, the improvement in decoupling is 23 db, namely 41 db as compared to 18 db, while the decrease in the antenna gain is 0.8 db. These values scarcely change upon change of the parameters a and b.

Figure 4:
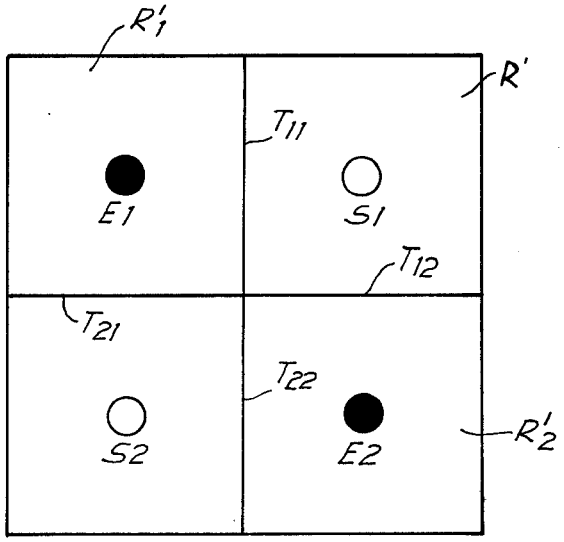
FIGS. 4 and 5, respectively, are views similar to FIG. 2, for second and third embodiments of the invention.

The second embodiment, shown in FIG. 4, is intended and suitable for the decoupling of four helical transmitting and receiving antennas S1 and S2 and E1 and E2, respectively, of an array of two pairs of antennas with oppositely directed circular polarization, the array being perpendicular to an electrically conductive flat square reflector wall R′ of sheet metal. The reflector wall R′ consists of two contiguous rectangular halves $R'_1$ and $R'_2$ along the junction line of which there are two abutting partition walls $T_{12}$ and $T_{21}$ which are electrically conductively connected both with one another and with the reflector wall R′. On one side of the array, the plane of the two partition walls $T_{12}$ and $T_{21}$ is midway between the transmitting antenna S1 and the receiving antenna E2, and on the other side of the array said plane is midway between the transmitting antenna S2 and the receiving antenna E1, while the two antennas E and S of each of the respective pairs of antennas 1 and 2 are screened from each other by partition walls $T_{11}$ and $T_{22}$, respectively, which also abut along the abutment line of the partition walls $T_{12}$ and $T_{21}$. The partition walls $T_{11}$, $T_{12}$, $T_{21}$ and $T_{22}$ may be flat metal sheets. The antenna array is such that the four antennas occupy the four corners of a square and that like antennas (similarly polarized) are diagonally opposite each other. The array of FIG. 4 thus represents a doubling of the first embodiment (FIGS. 1 and 2) and an interlacing of one pair of antennas with respect to the other.

Figure 5:
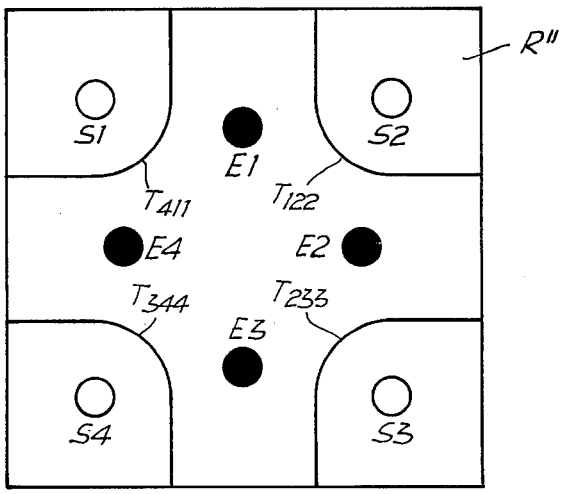

The third embodiment, shown in FIG. 5, is intended and suitable for the decoupling of eight helical transmitting and receiving antennas S1, S2, S3 and S4 and E1, E2, E3 and E4, respectively, of four pairs of antennas with oppositely directed circular polarization, wherein all antennas are perpendicular to an electrically conductive flat square reflector wall R″ of sheet metal. The antenna arrangement in this case is such that the four transmitting antennas S occupy the four corners of a larger square and are on the diagonals of the reflector wall R″ and that the four receiving antennas E occupy the four corners of a smaller square and are on the center lines of the reflector wall R″, antenna E1 being close to the geometrical plane which includes the axes of antennas S1 and S2. The same applies to antenna E2 with respect to the geometrical plane which includes the axes of antennas S2 and S3, antenna E3 with respect to the geometrical plane which includes the axes of antennas S3 and S4, and antenna E4 with respect to the geometrical plane which includes the axes of antennas S4 and S1. The decoupling-improving device of this symmetrical antenna array is itself of symmetrical development and is shown to comprise four identical cylindrically curved partition walls T of sheet metal, the curve of each wall T being positioned concentrically about its associated transmitting antenna S, a first partition wall $T_{122}$ being disposed midway between antenna S2 on the one hand and antennas E1 and E2 on the other hand, a second partition wall $T_{233}$ being disposed midway between antenna S3 on the one hand and antennas E2 and E3 on the other hand, a third partition wall $t_{344}$ being disposed midway between antenna S4 on the one hand and antennas E3 and E4 on the other hand, and the fourth partition wall $T_{411}$ being disposed midway between antenna S1 on the one hand and antennas E4 and E1 on the other hand. The partition walls $T_{122}$, $T_{233}$, $T_{344}$ and $T_{411}$ are perpendicular to the reflector wall R″ and are electrically conductively connected thereto.

What is claimed is:

1. An array of one or more pairs of helical transmitting and/or receiving antennas in which the antennas of each pair have oppositely directed circular polarization and are disposed perpendicular to an electrically conductive flat reflector wall, characterized by an electrically conductive partition wall (T) which is positioned midway between the two antennas of one of said pairs of antennas, and particularly between a transmitting and a receiving antenna (S,E), said partition wall being also perpendicular to said reflector wall (R) and electrically conductively connected thereto and having a height measured perpendicular to said reflector wall corresponding to substantially one half the wavelength (λ) of the design frequency of said array.

2. An array according to claim 1 characterized by the fact that a metal sheet or grid with small mesh size as compared with the wavelength (λ) is provided as the partition wall (T).

3. An array according to claim 1 or 2, comprising a pair of antennas, characterized by the fact that the partition wall (T) is flat and that its length (b) measured parallel to the reflector wall (R) corresponds at least to the wavelength (λ).

4. An array according to claim 1 or 2, comprising two pairs of antennas, characterized by the fact that the two transmitting antennas (S1, S2) on the one hand and the two receiving antennas (E1, E2) on the other hand are arranged diagonally, that a flat partition wall ($T_{11}$, $T_{12}$, $T_{21}$) is arranged between every two antennas, and that the partition walls abut in the center of the antenna array and are electrically conductively connected.

5. An array according to claim 1 or 2, comprising four pairs of antennas, characterized by the fact that the four transmitting or receiving antennas (S1, S2, S3, S4) occupy the four corners of an outer square; that the four receiving or transmitting antennas respectively (E1, E2, E3, E4) occupy the four corners of an inner square which is at 45° rotational offset with respect to the outer square; and that between each outer transmitting or receiving antenna (S1, S2, S3, S4) and the two adjacent inner receiving or transmitting antennas (E1 and E4, E1 and E2, E2 and E3, E3 and E4) a partition wall ($T_{122}$, $T_{233}$, $T_{344}$, $T_{411}$) is provided spaced from and arcuately curved about said outer transmitting or receiving antenna.

6. An antenna array comprising at least two antennas characterized by opposite directions of circular polarization, said antennas being of equal length along their respective axes and respectively adapted to transmission and reception at substantially the same wavelength, a conductive base reflector wall with respect to which said antennas extend perpendicularly and in spaced parallel relation from each other, the spacing being at least approximately one wavelength and the minimum extent of said reflector wall from each antenna axis being at least substantially one wavelength, and a conductive partition wall conductively connected to said reflector wall and upstanding therefrom between said antennas to the extent of substantially a half wavelength and at minimum offset of at least a half wavelength from the axis of each of said antennas, the transverse extent of said partition wall being at least one-half wavelength on each side of the geometrical plane which includes the axes of both said antennas.

* * * * *